United States Patent [19]

Earle

[11] 4,070,898

[45] Jan. 31, 1978

[54] TOOL FOR RESETTING AIRCRAFT SPARK PLUG GAP

[75] Inventor: Ronald A. Earle, Los Angeles, Calif.

[73] Assignee: Aircraft Inspections, Los Angeles, Calif.

[21] Appl. No.: 752,163

[22] Filed: Dec. 20, 1976

[51] Int. Cl.[2] ..... B21D 9/08

[52] U.S. Cl. ..... 72/409; 81/418

[58] Field of Search ..... 81/426, 418; 72/409

[56] References Cited

U.S. PATENT DOCUMENTS

| | | | |
|---|---|---|---|
| 2,350,057 | 5/1944 | Martin | 72/409 |
| 2,645,142 | 7/1953 | Schwenzfiëler | 72/409 |
| 2,670,643 | 3/1954 | Clark | 72/409 |

*Primary Examiner*—James L. Jones, Jr.
*Attorney, Agent, or Firm*—Lindenberg, Freilich, Hornbaker, Wasserman, Rosen & Fernandez

[57] ABSTRACT

A simple and compact tool for use with aircraft spark plugs to reset the spark gap, which enables a person to hold the spark plug to the tool, hold a gauge to the spark plug, and squeeze the electrodes of the spark plug to set the gap, all under field conditions. The tool includes a pair of bars pivotally connected at one end and a nut fixed to a first of the bars to loosely hold a spark plug, the nut having a cut-away portion to permit the second bar to move over a spark plug held by the nut, and the second bar having a recessed edge which can move against an electrode of the spark plug to bend it.

5 Claims, 4 Drawing Figures

Fig. 1
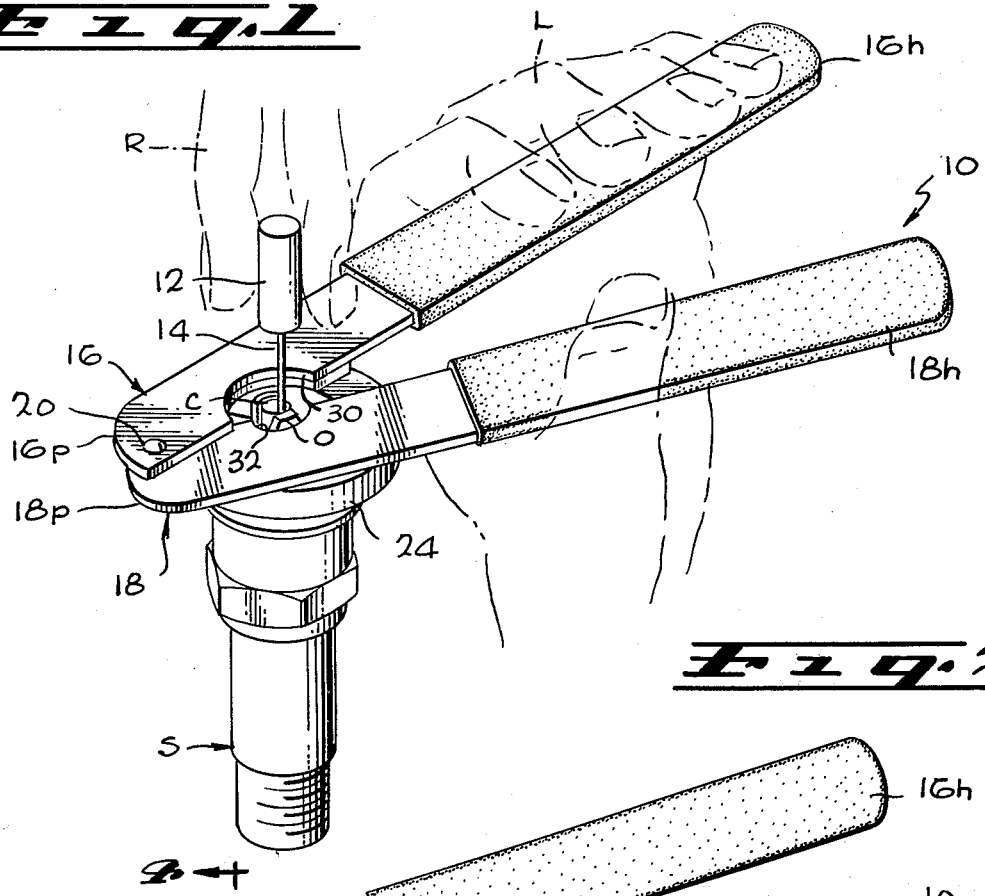
Fig. 2
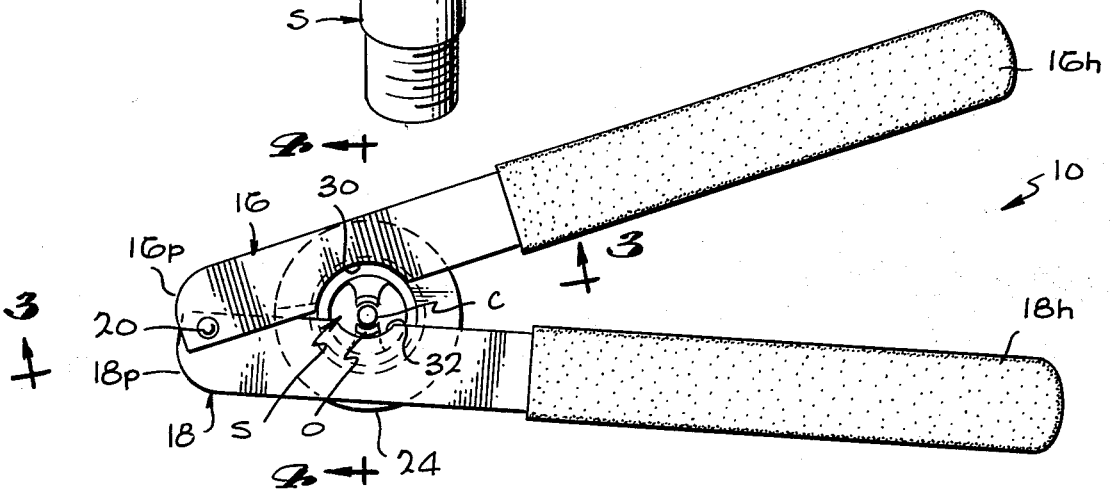
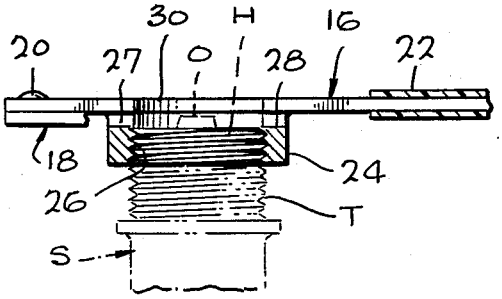
Fig. 3
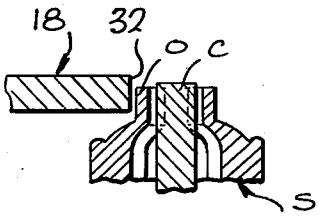
Fig. 4

TOOL FOR RESETTING AIRCRAFT SPARK PLUG GAP

BACKGROUND OF THE INVENTION

This invention relates to a tool for resetting the gap of an aircraft-type spark plug.

Aircraft-type spark plugs normally include a central cylindrical electrode and a pair of strip-like outer electrodes located on opposite sides of the central electrode and bent so that their ends extend parallel to the central cylindrical electrode. During their operation, the electrodes wear away, and after a period such as 75 hours of flight time the gaps between the central and outer electrodes must be reset. Heretofore, the available resetting tools utilized a frame designed to be mounted on a bench, and a threaded member which could be turned to advance against an outer electrode while the mechanic held a gauge between the outer and center electrodes to accurately reset the gap. Such a tool had been too cumbersome for pilots of small planes to carry in their tool kit so the pilots could reset the gap when operating in countries where reliable maintenance services are not available. In addition, the resetting devices required several steps in their operation which retarded the work of mechanics who wished to reset a set of spark plugs quickly.

SUMMARY OF THE INVENTION

In accordance with one embodiment of the present invention, a tool is provided for resetting the gap of aircraft spark plugs, which is of simple and compact design to facilitate use by a pilot in the field, and which permits rapid use on spark plugs in shop use. The tool includes a pair of bars pivotally joined at pivot ends and having opposite handle ends, with a first bar lying over the other one and carrying a nut on its lower surface for loosely receiving a spark plug. The second bar has a recess positioned so that when the handles are squeezed together and a spark plug is properly positioned in the nut, the walls of the recess move against an outer electrode of the spark plug to squeeze it towards the center electrode. The fact that a person holding and squeezing the handles supports the tool and the spark plug thereon all with one hand, means that he can easily hold a gauge in his other hand to assure accuracy in resetting. Thus, the tool can be held in the hand instead of requiring it to be mounted on a workbench, and this plus the compactness of the tool enables it to be carried by a pilot for gap resetting in the field. In addition, the tool permits a mechanic in a shop to rapidly install spark plugs and reset their gaps while he works at the airplane.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of the tool of the present invention, showing the manner of its use;

FIG. 2 is a plan view of the tool of FIG. 1;

FIG. 3 is a view taken on the line 3—3 of FIG. 2; and

FIG. 4 is an enlarged view taken on the line 4—4 of FIG. 2.

DESCRIPTION OF THE PREFERRED EMBODIMENT

As illustrated in the figures, the tool 10 of the present invention is designed to receive a standard aircraft spark plug S and squeeze an outer electrode O of the spark plug closer to a central electrode C of the spark plug, to reduce the gap between them which has been enlarged as a result of use. Generally, a gauge device 12 is utilized which has a gauge wire 14 that is positioned between the electrodes O, C as they are squeezed together, to assure accurate setting of the gap.

The spark plug gap resetting tool 10 includes a pair of bars 16, 18 which have pivot ends **16*p*, 18*p* pivotally connected together as by a loosely installed rivet 20. Each of the bars also has an opposite handle end 16*h*, 18*h* which includes a plastic covering 22. A spark plug-holding member or nut 24 is mounted on the underside of the first of the bars 16 to hold the spark plug, while the second bar 18 is pivotally mounted under the first bar. As shown in FIG. 3, the nut 24 has a threaded hole 26 to receive the threaded end T of the spark plug, and has a cut away portion 27 extending across most of the nut diameter up to an edge 28 to permit pivoting of the second bar 18 over the side of a spark plug which is held by the nut. The first bar 16 has a recess 30 lying over the threaded hole 26 of the nut to avoid interference with screwing up of the spark plug into the nut, while the second bar 18 has a small recess 32** to enable close surrounding of the outer electrode O of the spark plug to facilitate bending it.

In order to reset the gap of a spark plug, a workman first grasps the tool by the handles **16*h*, 18*h* and spreads the bars apart. He then screws the head end H of a spark plug S into the threaded hole 26 of the nut, until one of the outer electrodes O lies opposite the recess 32 in the second bar and the spark plug head is at a height which permits the second bar 18 to pass over the edge of the spark plug head. The workman then grasps the gauge device 12 in the fingers of one hand R which is usually his right hand, to insert the gauge wire 14 into the spark plug gap, and squeezes the bars together with his other hand L which is usually the left hand, in the manner illustrated in FIG. 1. It has been found through operation of an actual device of a type illustrated in the drawings, that a person of average strength can readily squeeze the handles of the tool together to bend the outer electrode O until it presses the gauge wire against the central electrode C, at which point the spark plug gap has been properly reset. The tool 10 has bars of a length of 6 inches, and with a distance of one inch between the pivot point at rivet 20 and the center of the nut hole 26. The threads of the nut hole 26 were formed with $\frac{3}{4}$ inch $\times$ 16 NF threads, which were found to loosely receive the standard 18 $\times$ 1.5 mm threads at the head of standard aircraft spark plugs, so that the spark plugs were firmly enough held for gap resetting by the tool and yet the threads on the spark plug rapidly entered and screwed up into the nut. Each of the bars 16, 18** are stamped from plates of metal, and with the handle ends dipped in a plastisol.

The fact that the tool 10 is of small size and does not have to be mounted on a workbench, means that it can be conveniently included in the tool kit of pilots, so that they can reset the gaps of their spark plugs in the field when competant service facilities are not available. It also has been found that in a shop environment, the tool permits much more rapid spark plug gap resetting than the prior art tools which had to be installed on a bench and required turning of a screw. It was found that a mechanic can carry the tool 10 to the area where he is working on the engine, and can rapidly install each spark plug, squeeze the handles to reset the gap, and remove the spark plug, so that an entire set of spark plugs can be reset very rapidly.

Thus, the invention provides a tool for resetting the gap of an aircraft-type spark plug, which can be easily included in a pilot's tool repair kit and used in the field to reset his spark plug gaps, and which can be utilized in an aircraft repair shop for rapid resetting of spark plug gaps. This is accomplished by a tool with a pair of pivotally connected bars, with a first bar mounted above the other one and carrying a threaded nut on its lower surface for receiving the head of a spark plug, the second bar having a recess for moving closely around the other electrode of a spark plug to press it against the center electrode. This type of tool is constructed of moderately small size, such as with an overall length of six inches, and has been found adequate to enable a person to easily reset the gap of an aircraft spark plug.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A tool for resetting the gap of an aircraft-type spark plug, comprising:

a pair of bars having pivot ends pivotally connected together and having opposite handle ends; and a spark plug-holding member with a threaded hole, mounted on a first of said elongated members at a location spaced from the pivot end thereof by less than half the length of said first member;

the second of said bars having a recess positioned so that when said bars are pivoted together, the recess on said second bar moves over the threaded hole of said spark plug-holding member, whereby a person can hold and operate the tool with one hand, with the spark plug held on the tool, while this other hand holds a spark gap gauge device.

2. The tool described in claim 1 wherein:

each of said bars comprises a plate of metal of constant thickness, with said second bar lying under said first bar, said spark plug-holding member comprising a nut, and said nut being cut-away across at least half of its diameter, which lies in the path of said second bar as it pivots toward said first bar.

3. The tool described in claim 1 wherein:

said threaded hole has threads of three-quarter inch outside diameter, with a thread spacing of sixteen threads per inch, whereby to loosely receive standard aircraft spark plugs that have threads of 18 millimeters outside diameter and with threads spaced 1.5 millimeter apart.

4. A tool for resetting the gap of an aircraft-type spark plug comprising:

first and second pivotally connected bars having handles that can be moved together and apart;

a nut member threaded to receive the threaded head of an aircraft-type spark plug, said nut member fixed to the underside of said first bar;

said second bar lying immediately under said first bar and said nut member being cut away along the top portion thereof which is in the path of said second bar.

5. The tool described in claim 4 wherein:

said bars are each approximately 6 inches in length, said bars are pivotally connected together at their ends opposite said handle ends thereof, and the axis of said nut is positioned approximately one inch from the pivot axis at which said bars are pivotally connected together.

* * * * *